United States Patent [19]

Holland et al.

[11] 3,979,242

[45] Sept. 7, 1976

[54] WALLPAPER DISPENSER AND METHOD OF OPERATION

[75] Inventors: Leo Holland; Joseph P. Holland; Alvina Holland, all of Westwood, N.J.

[73] Assignee: Lawrence Peska Associates, Inc., New York, N.Y. ; a part interest

[22] Filed: June 18, 1975

[21] Appl. No.: 588,033

[52] U.S. Cl. ..... 156/71; 156/324; 156/575; 156/576; 427/368

[51] Int. Cl.[2] ..... E04F 13/20

[58] Field of Search ..... 427/368; 156/71, 324, 156/543, 575, 576

[56] References Cited

UNITED STATES PATENTS

| | | | |
|---|---|---|---|
| 2,347,865 | 5/1944 | Yates et al. | 156/71 |
| 2,366,674 | 1/1945 | Petty | 156/71 |
| 2,668,124 | 2/1954 | Mallabar | 427/368 |
| 3,054,381 | 9/1962 | Meichtry | 156/71 |
| 3,116,195 | 12/1963 | Lathrop et al. | 156/71 |

*Primary Examiner*—Edward G. Whitby

*Attorney, Agent, or Firm*—Jack D. Slobod

[57] ABSTRACT

A wallpapering method and dispenser therefor which is adapted to be set on the floor and when so positioned, wallpaper is pulled upwards from the dispenser and pressed against a wall. The dispenser includes an anti-skid resilient base mat, a rotatable mounting gripping the ends of a roll of wallpaper and a paste application roller running in a reservoir for paste. The wallpaper is fed from its mounting over the paste application roller and then past a brush positioned in the dispenser for smoothing the applied paste and removing any excess thereof.

5 Claims, 5 Drawing Figures

WALLPAPER DISPENSER AND METHOD OF OPERATION

FIELD OF THE INVENTION

The present invention relates generally to machines for dispensing and applying paste to wallpaper. In its particular aspects, the present invention relates to a wallpaper dispenser adapted to remain positioned at the base of a wall to be papered, as paste-coated wallpaper is pulled upwards from the dispenser.

BACKGROUND OF THE INVENTION

Wallpaper is generally hung by laying out a strip of paper upside down on a work surface and applying paste thereto. The pasted wallpaper is then lifted up and applied to a wall. It is indeed very cumbersome to handle a large strip of pasted wallpaper by this aforementioned technique.

Various machines have been disclosed in the prior art for retaining a roll of wall paper and for applying paste thereto as the paper is unrolled. Such machines, which also have rollers for applying the wallpaper to a wall as the paper exits the machine, are quite difficult to use because of their inherent bulk. This is because such machines must be physically lifted and run along the wall to apply the wallpaper.

Furthermore such machines do not apply paste sufficiently uniformly to the wall paper which yields lumpy spots in the applied paper.

OBJECTS OF THE INVENTION

It is an object of the invention to provide a method of wallpapering which is simple and requires no lifting of bulky items.

It is another object of the present invention to provide a wallpaper dispenser capable of applying paste smoothly and uniformly along the wallpaper as it is dispensed.

SUMMARY OF THE INVENTION

Briefly, the aforementioned and other objects of the present invention are satisfied by providing a paste applying dispenser for a roll of wallpaper which dispenser is adapted to be maintained on the floor at the base of a wall to be papered as the wallpaper is dispensed by pulling a free end of the wallpaper vertically upwards from the dispenser. The wallpaper after being dispensed to the desired height is pressed against the wall.

One feature of the dispenser of the present invention is a brush maintained therein for smoothing out the applied paste on the wallpaper and for removing any excess thereof.

Another feature of the dispenser is the provision of collars for gripping the ends of a wallpaper roll to restrict the unrolling paper therefrom to be even with the roll.

Yet another feature of the dispenser of the present invention is an anti-skid base of resilient material for maintaining the dispenser in place at the base of a wall.

Other objects, features and advantages of the present invention will become apparent upon perusal of the following detailed description of the preferred embodiment thereof when taken in conjunction with the appended drawing wherein.

DETAILED DESCRIPTION

Figure 1:
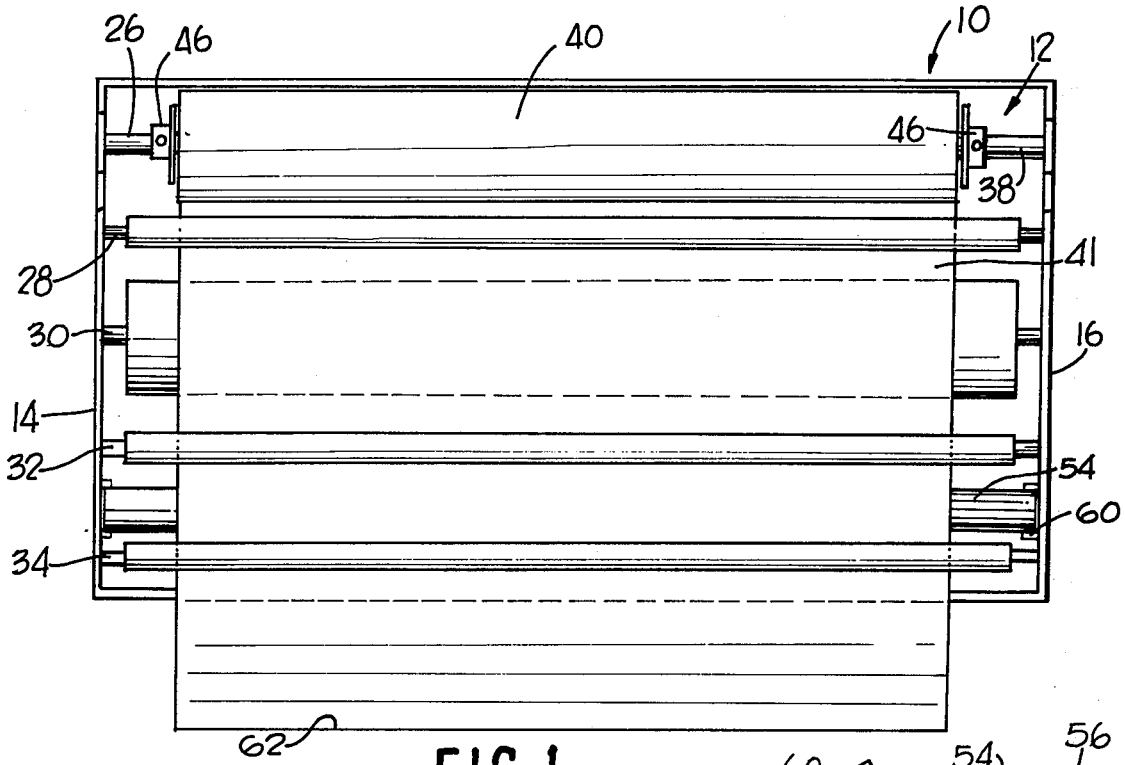
FIG. 1 is a plan view of the wallpaper dispenser of the present invention.
Figure 2:
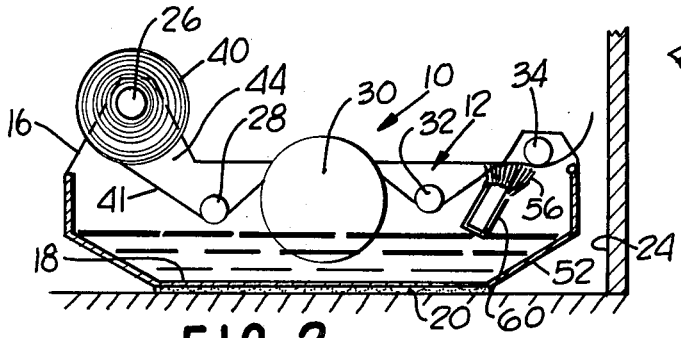
FIG. 2 is a cross-sectional side view of the wallpaper dispenser in FIG. 1.

Referring first to FIGS. 1 and 2 of the drawing, the wallpaper dispenser 10 of the present invention comprises a housing well 12 including an opposed pair of sidewalls 14 and 16 and a flat base 18. The base 18 has an anti-skid resilient rubber mat 20 glued to its bottom surface to allow the dispenser 10 to be frictionally maintained in place on the floor 22 at the base of a wall 24 to be papered.

Between the sidewalls 14 and 16 are located five parallel spaced apart rollers 26, 28, 30, 32 and 34 having their opposite ends rotatably journalled in each sidewall.

Figure 5:
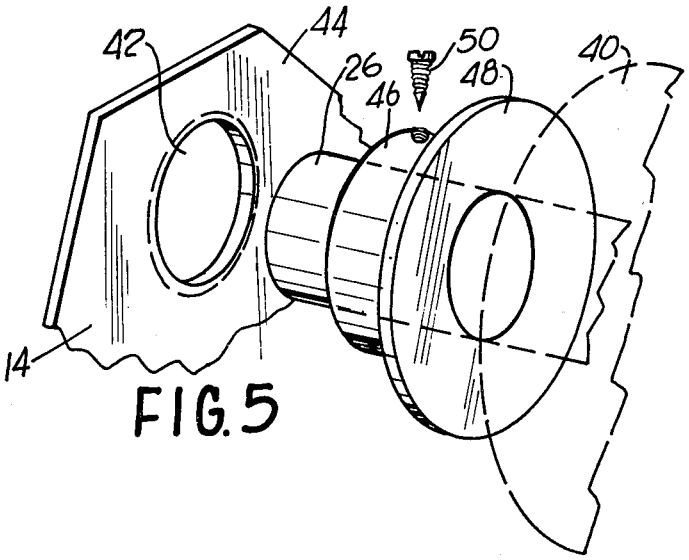

Referring also to FIG. 5, roller 26 comprises a long dowel which is removeably inserted through the center of a roll 40 of wallpaper 41. The opposite ends of dowel 26 are journalled in opposed clearance holes 42 provided in trapezoidal tabs 44 upstanding from the rear ends of each of the sidewalls 14 and 16. To place wallpaper roll 40 in dispenser 10, the roll is positioned between clearance holes 42 and the dowel 26 is inserted through one of the holes and into the roll. In order to capture dowel 26 between sidewalls 14 and 16, a pair of collars 46 are provided slideable along dowel 26. The collars 46 are locked in place with their large annular faces 48 tightly against the ends of wallpaper roll 40 utilizing set screws 50 which are threaded radially into collars 46 and bear against dowel 26. Preferably annular faces 48 are sized to approximate the diameter of wallpaper roll to grip the ends of the roll and to guide the wallpaper 41 straightly as it leaves the roll 40.

Wallpaper 41, as it is unwound from the underside of roll 40 is threaded under roller 28 which is a guide roller.

The roller 30 is the larget diameter roller and is provided with a surface of absorbent material. The bottom of housing well 12 comprises a reservior 52 for wallpaper paste and roller 30 is mounted partially submerged below the level of paste therein. Thus the roller 30 serves as a paste applicator. The wallpaper 41, as it leaves guide roller 28 is threaded over the top of paste application roller 30. After passing over roller 30, wallpaper 41 is threaded under roller 32 which also serves as a guide roller. The guide rollers 28 and 30 are positioned on opposite sides of roller 30 to force the wallpaper 41 to bear down tightly on top of roller 30 in order to pick up paste therefrom.

Figure 3:
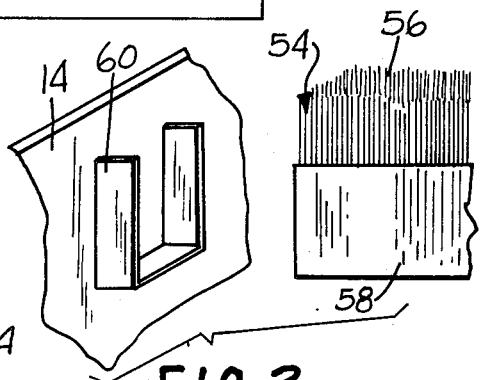
FIGS. 3, 4 and 5 are pictorial presentations of detailed enlargements of portions of the wallpaper dispenser in FIGS. 1 and 2.
Figure 4:
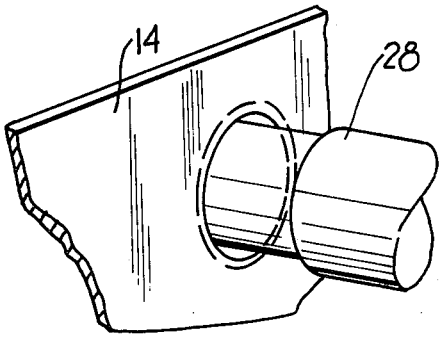

Now referring also to FIG. 3, downstream from guide roller 32, there is positioned an elongated brush 54 which is directed between sidewalls 14 and 16. Brush 54 comprises upstanding bristles 56 rooted in a rectangular wooden block 58. Block 58 is retained at an oblique angle with respect to base 18 in a pair of U-shaped brackets 60 carried by the sidewalls 14 and 16. The wallpaper 41 as it leaves guide roller 32 is fed over the bristles 56 of brush 54. The brush 54 serves to smooth the paste which the wallpaper picks up from roller 30 in even manner. In addition, the brush 54 scrapes off excess paste from the wallpaper 41.

After passing over the brush 56 the wallpaper 41 is threaded under roller 34 which also serves as a guide roller. The rollers 32 and 34 are positioned to force the wallpaper down tightly against the angled upstanding brush bristles 56 to enhance the smoothing and scraping action of brush 54. After passing under roller 34 the wallpaper 41 exists dispenser 10 with a free end 62.

In the use of dispenser 10, in contradistinction to prior art methods of wall papering, the free end 62 of the wallpaper is pulled up vertically from dispenser 10 along, but spaced from, wall 24. This pulling action unrolls wallpaper roll 40 and simultaneously causes the paste to be applied by application roller 30. In addition, the smoothing and excess paste removal by brush 54 also occurs simultaneously with the pulling of free end 62.

With the dispenser 10 maintained in positioned on floor 22, by anti-skid mat 20, the free end 62 is lifted to a desired height and the unrolled wallpaper is pressed against the wall 24 with the hands. The bottom of the applied wallpaper is then cut from dispenser 10 and the process may again be repeated for application of an adjacent strip of wallpaper by shifting the location of dispenser 10.

Having described in detail, the preferred embodiment of the present invention, it should be apparent that numerous modifications, additions and omissions in the details thereof are possible within the intended spirit and scope of the invention. Accordingly, the following claims define the scope of the invention.

What is claimed is:

1. A wallpaper dispenser apparatus comprising: a housing, means on said housing for rotatably mounting a roll of wallpaper, a reservoir for paste formed in said housing, applicator means communicating with said reservoir, said applicator means positioned for receiving wallpaper from said mounting means, brush means positioned in said housing to act on wallpaper coming from said applicator means for removing excess paste from said wallpaper, wherein said housing has a base adapted to rest on the floor as wallpaper is pulled from said dispenser, said mounting means for said roll of wallpaper being positioned proximate said base in order that said roll of wallpaper may be located at the base of a wall to which said wallpaper is to be applied, said dispenser being configured to enable said wallpaper to be pulled vertically upward from said dispenser while being unrolled from said mounting means and passed by said applicator means, said applicator means being configured for applying paste to the side of said vertically upward directed wallpaper which faces said wall.

2. The apparatus of claim 1 wherein said bases comprises a resilient anti-skid mat.

3. The apparatus of claim 1 wherein said rotatable mounting means comprises a shaft rotatably mounted in said housing for passage through the center of said roll of wallpaper; a pair of collars slideably mounted on said shaft; said collars being positionable along said shaft for respectively bearing against opposite ends of said roll of wallpaper; and means for locking said collars to said shaft to rotate with said shaft as a unit.

4. A method of applying wallpaper to a wall comprising: maintaining a rotatable mounting for a roll of wallpaper positioned at the base of a wall, unrolling wallpaper by pulling a free end of said wallpaper upwards, maintaining said unrolled wallpaper directed vertically upwards along said wall and spaced from said wall, while unrolling, applying paste to the side of said vertically upwards directed wallpaper which faces said wall, and pressing said unrolled wallpaper against said wall.

5. The method of claim 4 further comprising scraping excess paste from said wallpaper while unrolling said roll.

* * * * *